US005907214A

United States Patent [19]

Yukimatsu et al.

[11] Patent Number: 5,907,214

[45] Date of Patent: May 25, 1999

[54] DEFLECTION YOKE WITH COILS FOR REDUCING UNWANTED MAGNETIC FIELD RADIATION

[75] Inventors: Takanori Yukimatsu; Soichi Sakurai; Hiroshi Jitsukata, all of Yokohama; Yoshio Satoh, Chiba-ken; Hiroshi Yoshioka, Mobara; Masao Obara, Yokohama, all of Japan

[73] Assignees: Hitachi, Ltd., Tokyo; Hitachi Media Electronics Co., Ltd., Mizusawa, both of Japan

[21] Appl. No.: 08/761,500

[22] Filed: Dec. 6, 1996

[30] Foreign Application Priority Data

| | | | |
|---|---|---|---|
| Dec. 7, 1995 | [JP] | Japan | 7-318808 |
| Apr. 5, 1996 | [JP] | Japan | 8-083957 |
| Apr. 16, 1996 | [JP] | Japan | 8-094315 |

[51] Int. Cl.[6] ..... H01J 29/70

[52] U.S. Cl. ..... 313/440; 313/479; 313/313; 335/213

[58] Field of Search ..... 313/440, 479, 313/313, 439; 335/213

[56] References Cited

FOREIGN PATENT DOCUMENTS 62-64024 3/1987 Japan .

3-289029 12/1991 Japan .

7-211267 8/1995 Japan .

*Primary Examiner*—Vip Patel

*Attorney, Agent, or Firm*—Antonelli, Terry, Stout & Kraus, LLP

[57] ABSTRACT

A cathode ray tube display device including unnecessary radiating magnetic field reducer which improves the ability to reduce an unnecessary radiating magnetic field, especially, generated by a vertical deflection coil. A pair of coil is disposed in opposing relationship on the opposite sides of the ferrite core along an X-axis or in the horizontal direction of the deflection yoke so as to be in contact with an open side end of the ferrite core. Each coil has a shape curved with a predetermined radius of curvature conforming to the shape of the outer peripheral surface of the ferrite core. The ferrite core acts as a magnetic material for the coils which reduces the unnecessary radiating magnetic fields to increase the coil inductances to thereby produce a large extremely low frequency magnetic field (ELMF) reducing effect.

11 Claims, 7 Drawing Sheets

DEFLECTION YOKE WITH COILS FOR REDUCING UNWANTED MAGNETIC FIELD RADIATION

BACKGROUND OF THE INVENTION

The present invention relates to cathode ray tube display devices with unnecessary radiating magnetic field reducing means which reduces an unnecessary radiating magnetic field due to a magnetic field leaking from deflection coils wound around a deflection yoke of a cathode ray tube such as a display monitor, and more particularly to measures to be taken against an unnecessary radiating magnetic field from a vertical deflection coil.

Unnecessary radiating magnetic fields which will be produced around a CRT display device, Visual Display Unit (VDU), are said to be reduced to within a predetermined value because detrimental effects to human bodies and/or electronic devices present in the unnecessary radiating magnetic fields are required to be prevented. Especially, for an unnecessary radiating magnetic field in a low frequency band below 400 kHz, there is guidelines, for example, called TCO which stipulates that an extremely low frequency magnetic field (ELMF) of 5 Hz–2 kHz and a very low frequency magnetic field (VLMF) of 2–400 kHz should be restricted to within 200 and 25 [nT], respectively, at each of a measuring point on the periphery of a circle having a radius of 50 [cm] at whose center the VDU is situated and a measuring point distant by 30 [cm] from the CRT tube face.

Since a main source for generating an unnecessary radiating magnetic field of such a low frequency band is the deflection yoke, many display devices are proposed which reduce the unnecessary radiating magnetic field to within a stipulated value, for example, by providing means in the deflection yoke for generating a magnetic field which cancels the unnecessary radiating magnetic field.

As a specified example, an unnecessary radiating magnetic field reducing device disclosed in JPA-3-289029 is provided with a first cancel coil connected in series or parallel with the horizontal reflection coil, and a second cancel coil connected in a series or parallel with the vertical deflection coil, the first and second cancel coils being disposed around the deflection yoke, so as to generate a canceling magnetic field opposite to an unnecessary radiating magnetic field from the deflection yoke to cancel the unnecessary radiating magnetic field.

FIG. 10 shows this conventional unnecessary radiating magnetic field reducing device. Reference numeral 1 denotes the deflection yoke; 2 a deflection coil bobbin; 3 the vertical deflection coil; and 4 a magnetic ferrite core; 55*a*, 55*b*, 56 each the cancel coil which cancels the unnecessary radiating magnetic field. The cancel coils 55*a* and 55*b* connected to the horizontal deflection coil and the cancel coil 56 connected to the vertical deflection coil 3 generate magnetic fields which cancel unnecessary radiating magnetic fields generated from the horizontal and vertical deflection coils depending on the respective horizontal and vertical scanning frequencies, respectively, to reduce the unnecessary radiating magnetic fields.

The setting positions of the cancel coils are distant from the unnecessary radiating magnetic field generating sources in the conventional unnecessary radiating magnetic field reducing device, so that there are large unnecessary radiating magnetic fields around the VDU which cannot be canceled by the cancel coils.

SUMMARY OF THE INVENTION

It is therefore an object of the present invention to reduce such unnecessary radiating magnetic fields efficiently and more particularly to provide a cathode ray tube display device with an unnecessary radiating magnetic field reducing means which greatly reduces unnecessary radiating magnetic fields which will be generated from the vertical deflection coil.

In order to achieve the above object, the present invention provides a cathode ray tube display device which includes a cathode ray tube to which a deflection yoke is attached, the deflection yoke having a horizontal and a vertical deflection coil for deflecting an electronic beam, and unnecessary radiating magnetic field reducing means for reducing an unnecessary radiating magnetic field due to a magnetic field leaking from the deflection yoke, said unnecessary radiating magnetic field reducing means comprising at least one pair of coils disposed in opposing relationship on the opposite sides of the ferrite core on or close to the outer peripheral surface of the ferrite core for generating a canceling magnetic field which opposes the unnecessary radiating magnetic field due to the magnetic field leaking from the deflection yoke.

DESCRIPTION OF THE PREFERRED EMBODIMENTS

Preferred embodiments of the present invention will be described next with reference to the accompanying drawings.

Figure 1:
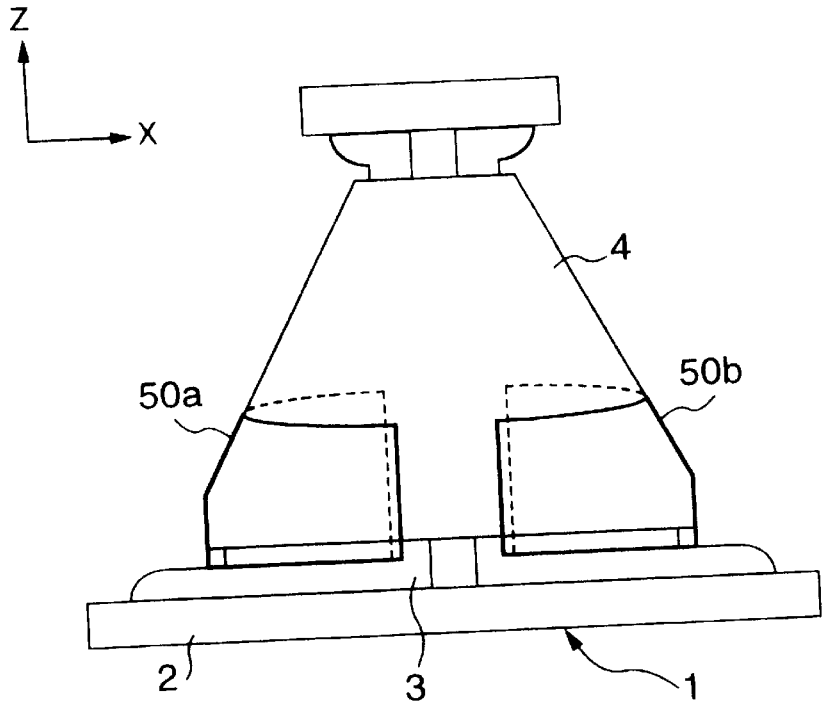
FIG. 1 is a top plan view of a deflection yoke with unnecessary radiating magnetic field reducing means as a first embodiment of the present invention.

FIG. 1 is a top plan view of a deflection yoke with unnecessary radiating magnetic field reducing means as a first embodiment of the present invention. In FIG. 1, reference numeral 1 denotes a deflection yoke; 2 a deflection coil bobbin; 3 a vertical deflection coil; and 4 a ferrite core which increases a magnetic field effective for deflection of an electronic beam.

Reference numerals 50*a* and 50*b* denote a pair of coils disposed in opposing relationship on the opposite sides of a ferrite core 4 in an X-axis direction, that is, in the horizontal-axis direction of the deflection yoke 1 so as to be in contact with an open end (a larger diameter side) of the ferrite core 4. The pair of coils 50*a*, 50*b* composes the unnecessary radiating magnetic field reducing means.

The coils 50*a* and 50*b* each take a form similar to each other so as to have a shape curved with a predetermined radius of curvature conforming to the outer peripheral surface of the ferrite core 4. The respective lengths of the coils 50*a* and 50*b* in the X-axis direction are about one third of the periphery of the opening end of the deflection yoke 1. The length of one of the coils in the Z-axis direction, that is, in a direction perpendicular to the horizontal and vertical axes of the deflection yoke 1, is about one half of the length of the ferrite core 4 in the Z-axis direction.

Figure 2:
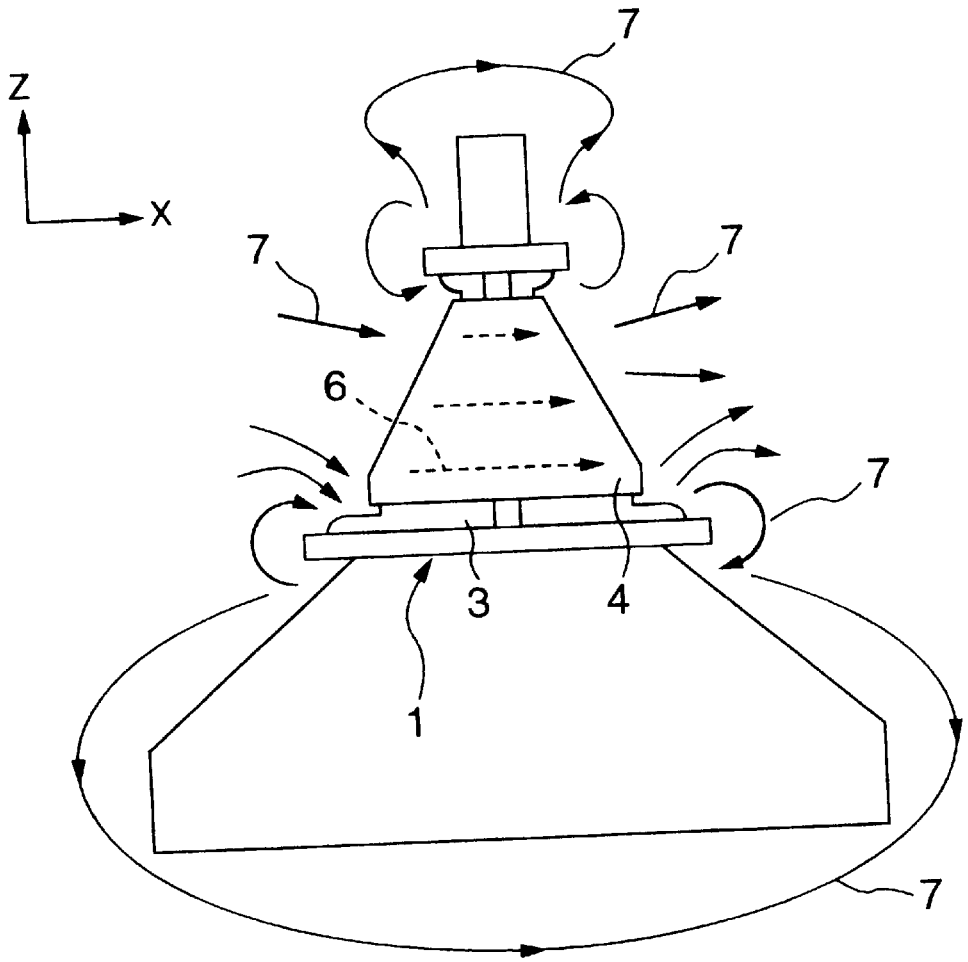
FIG. 2 shows a distribution of a magnetic field generated by a vertical deflection coil.

FIG. 2 shows a distribution of a magnetic field generated by the vertical deflection coil 3 when a deflection current flows through the deflection yoke 1. In FIG. 2, a magnetic field 6 generated by the vertical deflection coil 3 in a space surrounded by the vertical deflection coil 3 is effective as a proper vertical deflection magnetic field. However, simultaneously, an unnecessary radiating magnetic field 7 would leak in a space outside the vertical deflection coil 3. The present invention is intended to reduce the unnecessary radiating magnetic field 7 sufficiently by generating a magnetic field opposing the unnecessary radiating magnetic field 7.

The effect of reducing the unnecessary radiating magnetic field in the first embodiment will be described next.

Figure 3:
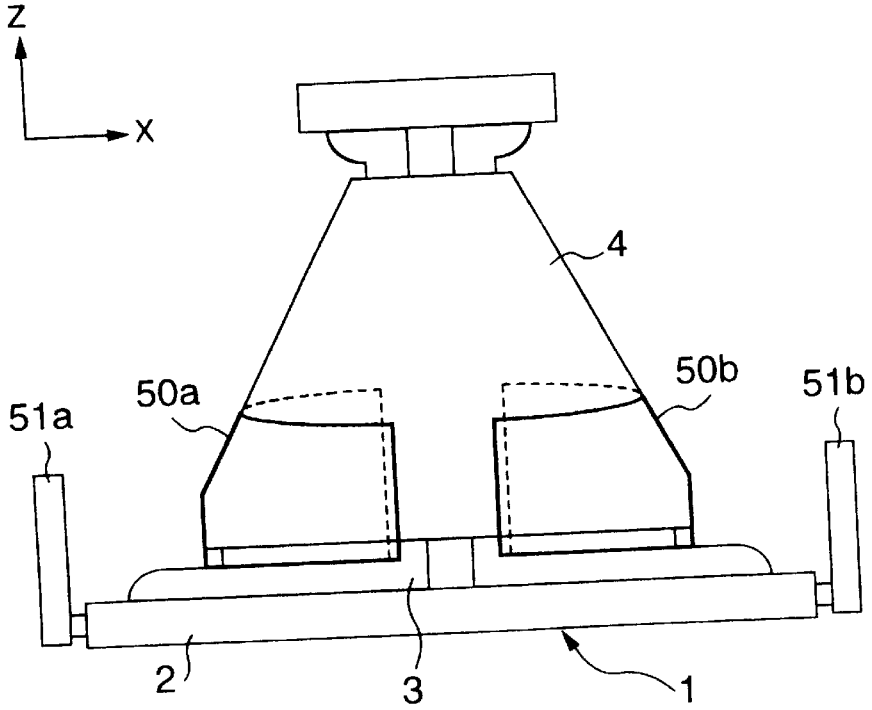
FIG. 3 shows the difference in structure between the first embodiment and the conventional unnecessary radiating magnetic field reducing measures.

FIG. 3 shows the difference between the first embodiment and the conventional unnecessary radiating magnetic field measures. Reference numerals 51*a* and 51*b* each denote an air-core coil used in the conventional unnecessary radiating magnetic field measures.

Figure 4:
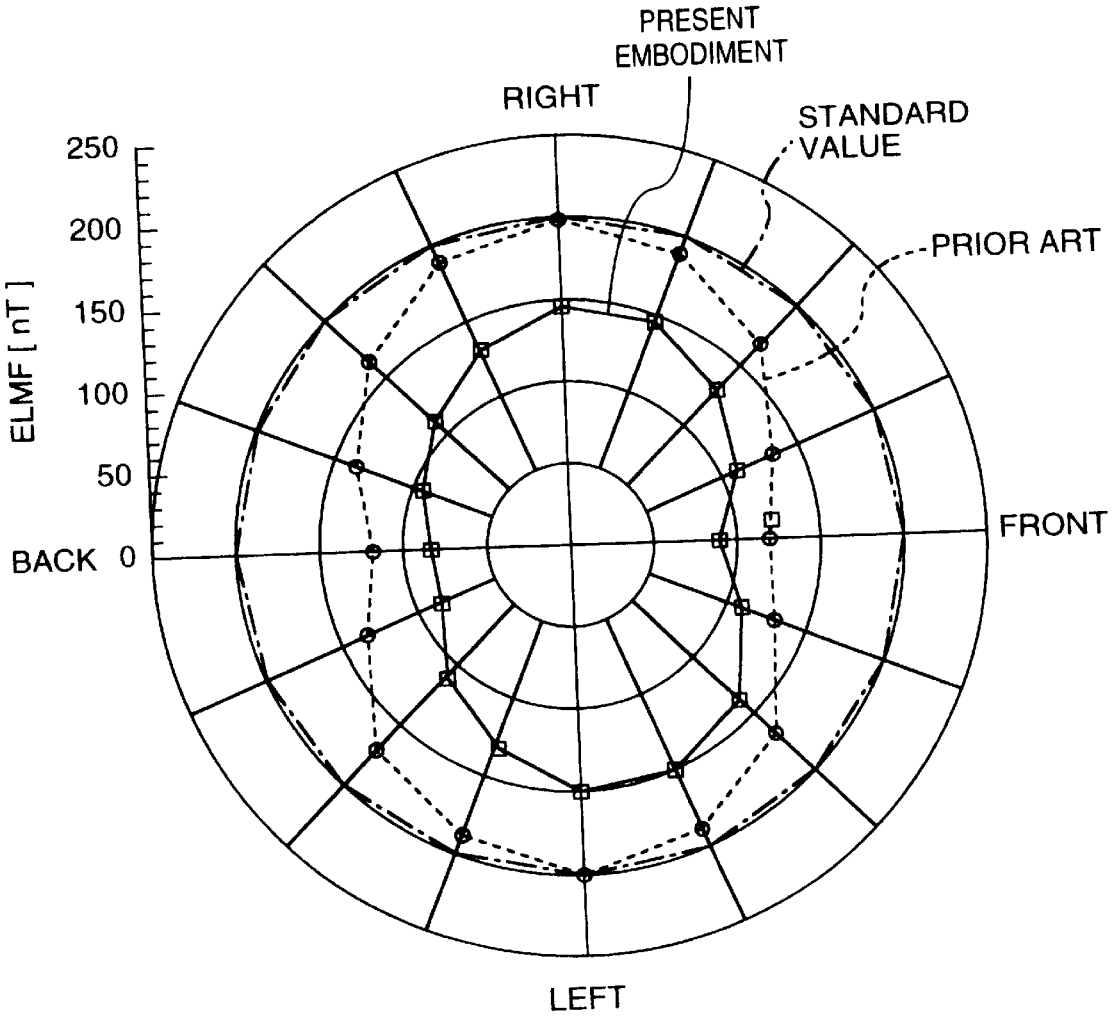
FIG. 4 shows the results of ELMF measurement by the first embodiment and the conventional unnecessary radiating magnetic field reducing measures.

FIG. 4 shows the results of measurement of the ELMFs by the conventional unnecessary radiating magnetic field measures and the first embodiment on the basis of above-mentioned guidelines. Broken line plotting denotes the result of measurement of the ELMF by the conventional unnecessary radiating magnetic field measures, dot-dashed line plotting denotes the upper limits (200 [nT]) of the standard values at the respective measuring points in the guidelines, and solid line plotting denotes the measured values of ELMF by the first embodiment.

In the ELMF measurement, the coil conditions employed which are the size, shape, and the numbers of coil turns are exactly the same as those employed in the first embodiment and the conventional measures.

In the first embodiment, the unnecessary radiating magnetic field is reduced by about 50 [nT] in the horizontal direction where the ELMF is maximum compared to the conventional unnecessary radiating magnetic field measures. Also, in other directions, the first embodiment reduces the unnecessary radiating magnetic field by about 20–50 [nT] compared to the conventional unnecessary radiating magnetic field measures.

Figure 5:
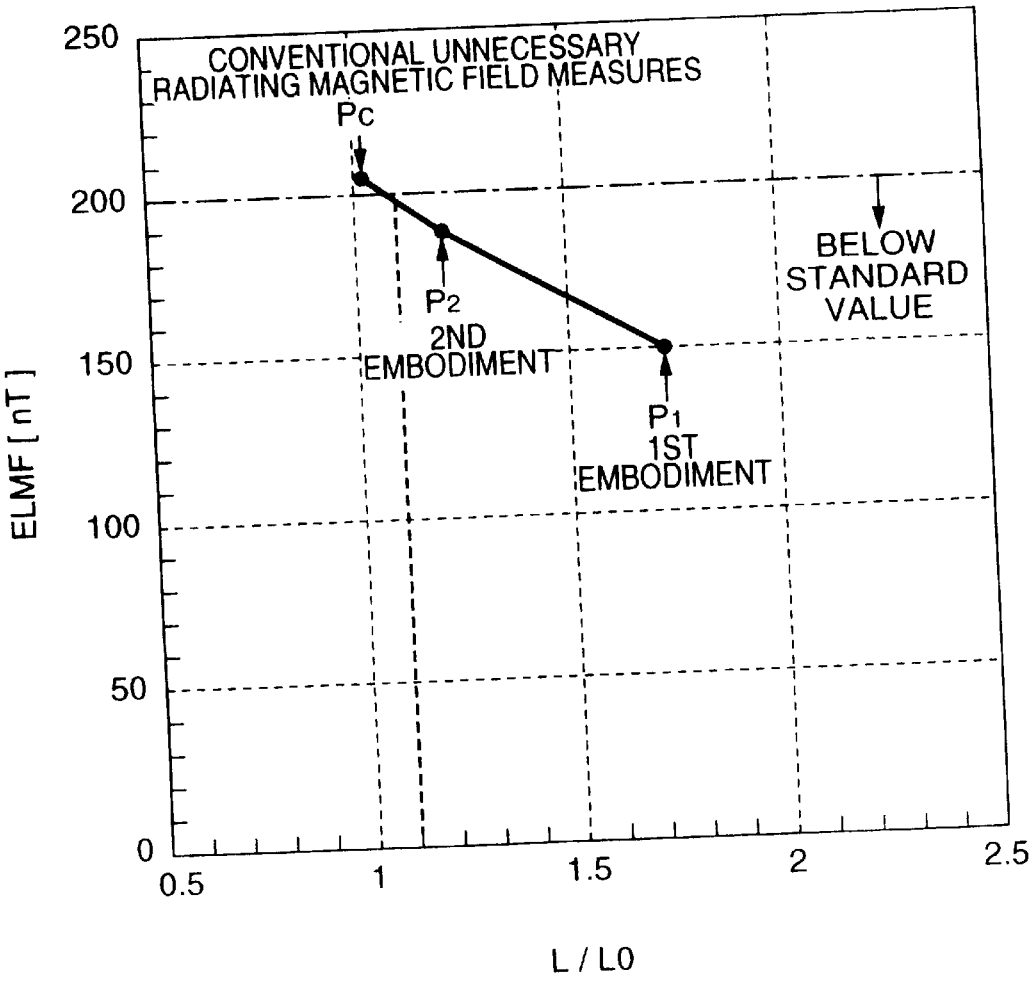
FIG. 5 shows the relationship between coil inductance and ELMF for the first embodiment and the conventional unnecessary radiating magnetic field reducing measures.

FIG. 5 shows the results of actual measurement of the inductances of the coils 50*a* and 50*b* in the first embodiment and, for example, the inductances of the air-core coils 51*a* and 51*b* of the conventional unnecessary radiating magnetic field measures, and plotting of the maxima of the measured data of ELMF at the respective measuring points based on the guidelines.

More specifically, FIG. 5 represents the ELMF obtained when a reference inductance whose value is 1.0 is the inductance L0 of an air-core coil disposed at a position free from the influence from the ferrite core 4 and L represents the inductance of the air-core coils 51*a* and 51*b* of the respective conventional unnecessary radiating magnetic field measures and the coils 50*a* and 50*b* of the first embodiment. That is, in FIG. 5, the vertical axis represents ELMF and the horizontal axis represents the values L/L0 obtained by dividing the inductance L of the coils 50*a*, 50*b* and 51*a*, 51*b* by the reference inductance L0.

In FIG. 5, the ratio of the inductance L of the air-core coils 51*a* and 51*b* of the conventional unnecessary radiating magnetic field measures to the reference inductance L0 is 1.008 and the ELMF (at a point Pc) at that time is 205 [nT] which is larger than the upper limit (200 [nT]) of the standard value of the guidelines.

In contrast, the ratio of the inductance L of the air-core coils 50*a* and 50*b* of the first embodiment to the inductance L0 of the air-core coil is 1.726 and the ELMF (at point P1) at that time is 150 [nT] which is smaller than the standard value of the guidelines.

In FIG. 5, it will be seen that the ELMF satisfies the standard value of the guidelines by disposing the unnecessary radiating magnetic field reducing coils 50*a* and 50*b* close to the ferrite core 4 such that the inductance L of the coils 50*a* and 50*b* of the first embodiment is 1.1 times L0.

As described above, by disposing the unnecessary radiating magnetic field reducing coils 50*a* and 50*b* close to the ferrite core 4 or in the direction in which the inductance of the unnecessary radiating magnetic field reducing coils 50*a* and 50*b* increases, the ferrite core 4 acts as a magnetic material body for the unnecessary radiating magnetic field reducing coils 50*a* and 50*b* to increase the inductance of the coils to thereby produce a large ELMF reducing effect.

The number of turns of coils 50*a*, 50*b* can be reduced until ELMF becomes the upper limit (200 [nT]) of the guideline standard value because the large ELMF reducing effect is produced by the first embodiment. The size of the coils 50*a* and 50*b* can be reduced until the upper limit is reached.

According to the first embodiment, it is not required to insert ferromagnets into the corresponding coils 50*a* and 50*b* to increase a canceling magnetic field as in the conventional unnecessary radiating magnetic field measures described above. Thus, the cost of the unnecessary radiating magnetic field reducing means is reduced.

That is, according to the first embodiment, a cathode ray tube display device with unnecessary radiating magnetic field reducing means is provided which improves the ability to reduce the unnecessary radiating magnetic field, especially, generated by the vertical deflection coil although it is small and inexpensive.

Figure 6:
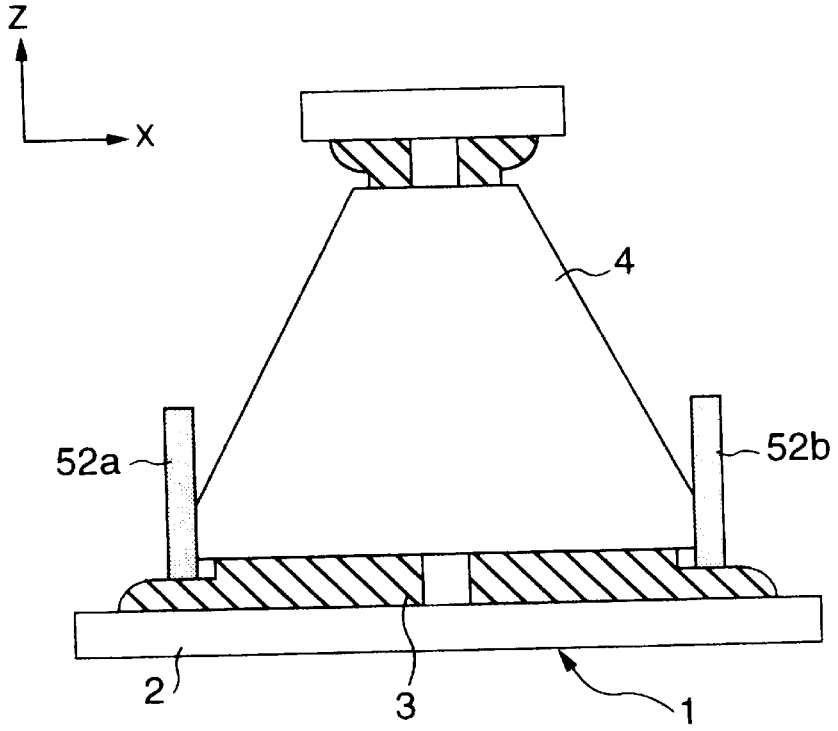
FIG. 6 is a top plan view of a deflection yoke with unnecessary radiating magnetic field reducing means as a second embodiment of the present invention.

FIG. 6 is a top plan view of a deflection yoke with unnecessary radiating magnetic field reducing means as a second embodiment of the present invention. In FIG. 6, the coils 52*a* and 52*b* as the unnecessary radiating magnetic field reducing means each are of the flat type and are disposed in contact with the open end of the ferrite core 4 in opposing relationship on the opposite sides of the ferrite core 4. In this case, as shown by the other embodiment P2 of FIG. 5, the ratio of the inductance L of the coils 52*a* and 52*b* to the reference inductance L0 is 1.193 and the ELMF in that case is 188 [nT] which is below the guideline standard value.

The second embodiment also produces effects similar to those produced by the first embodiment.

While the first and second embodiments of the present invention described above are means for reducing unnecessary radiating magnetic field leaking mainly from the vertical deflection coil, the present invention is also effective as means for reducing an unnecessary radiating magnetic field leaking from the horizontal deflection coil. To this end, the coils 50*a* and 50*b* of FIG. 1 are required to be disposed in contact with the open end (larger diameter side) of the ferrite core 4 in opposing relationship on the ferrite core 4 in the Y-axis direction or in the vertical axis direction of the deflection yoke 1. By such composition, an unnecessary radiating magnetic field leaking from the horizontal reflection coil is greatly reduced.

Alternatively, a (first) pair of coils may be disposed in contact with the open end (larger diameter side) of the ferrite core 4 in opposing relationship on the opposite sides of the ferrite core 4 in the X-axis direction or in the horizontal axis direction of the deflection yoke 1 and another (second) pair of coils may be disposed in contact with the open end of the ferrite core 4 in opposing relationship on the opposite sides of the ferrite core 4 in the Y-axis direction or in the vertical axis direction of the deflection yoke 1.

Figure 7:
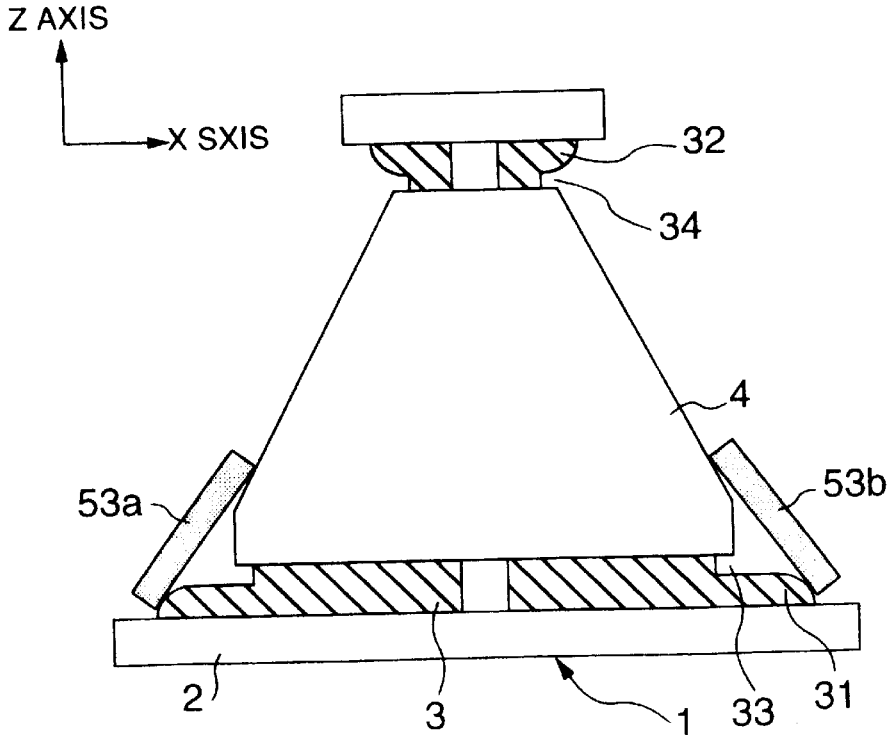
FIG. 7 is a top plan view of a deflection yoke in a third embodiment of the cathode ray tube display device according to the present invention.

FIG. 7 is a plan view of a deflection yoke in a third embodiment of the cathode ray tube display device according to the present invention. Reference numeral 1 denotes a deflection yoke; 3 a vertical deflection coil; 31 an open side fringe of the vertical deflection coil 3; 32 a neck side fringe of the vertical deflection coil 3; 4 a ferrite core; 53*a*, 53*b* each cancel the ferrite coil which cancels an unnecessary radiating magnetic field from the vertical deflection coil 3; 33 a spacing between the ferrite core 4 and the open side fringe 31 of the vertical deflection coil 3; and 34 a spacing between the ferrite core 4 and the neck side fringe 32 of the vertical deflection coil 3.

Figure 8:
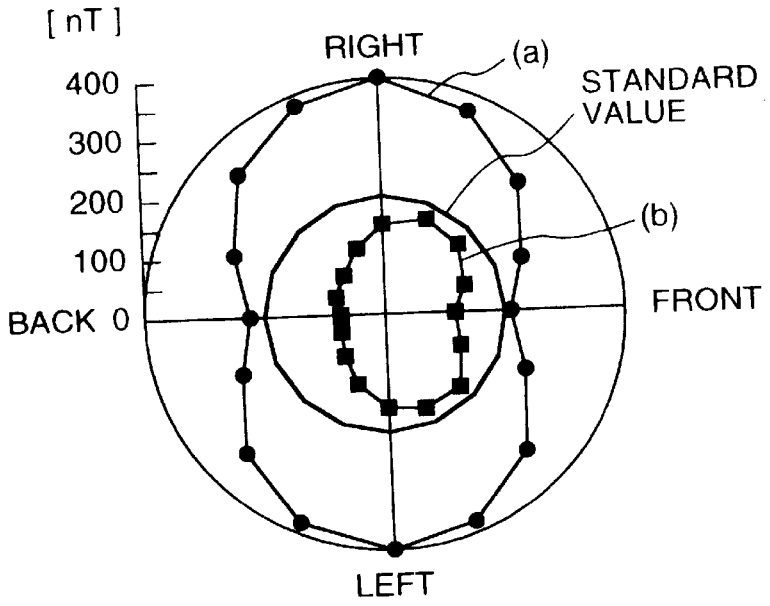
FIG. 8 shows the result of measurement of the unnecessary radiating magnetic field of FIG. 7.

FIG. 8 shows the result of actual measurement, for example, of ELMF in the cathode ray tube display device with the unnecessary radiating magnetic field reducing means of FIG. 7 according to the present invention in conformity to the TCO standard guidelines. In FIG. 8 1(*a*) denotes the measured ELMF values obtained when no unnecessary radiating magnetic field measures are taken whereas (b) shows the measured ELMF values obtained after the unnecessary radiating magnetic field reducing means according to the present invention is provided. As shown in (b), in the inventive cathode ray tube display device, the measured ELMF values are smaller than the TCO standard value (200 [nT]) at all the measuring points, which indicates that expected effects were obtained.

As will be seen from the above, an unnecessary radiating magnetic field 7 due to a magnetic field leaking from the vertical deflection coil 3 is reduced efficiently by disposing the cancel coils 53*a* and 53*b* at positions where the unnecessary radiating magnetic field 7 is strong on a line parallel to the ferrite core 4 of the deflection yoke 1 between the open side end and neck side end of the deflection yoke 1, for example at positions close to the ferrite core 4 and the open side fringe 31 of the vertical deflection coil so as to face the spacing 33 between the ferrite core 4 and the open side fringe 31 of the vertical deflection coil 3.

Alternatively, the cancel coils 53*a* and 53*b* may be connected to an external circuit which supplies a current whose wave form is similar to that of a vertical deflection current without being connected to the vertical deflection coil 3.

Figure 9:
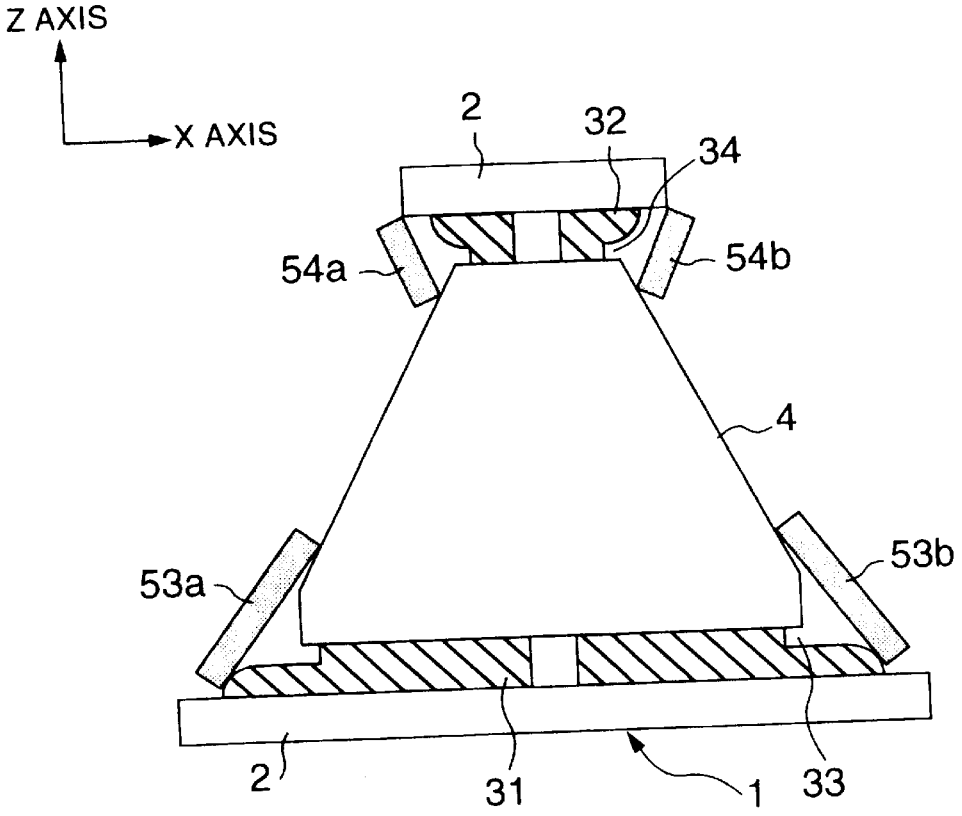
FIG. 9 is a top plan view of a deflection yoke in a fourth embodiment of the cathode ray tube display device according to the present invention.
Figure 10:
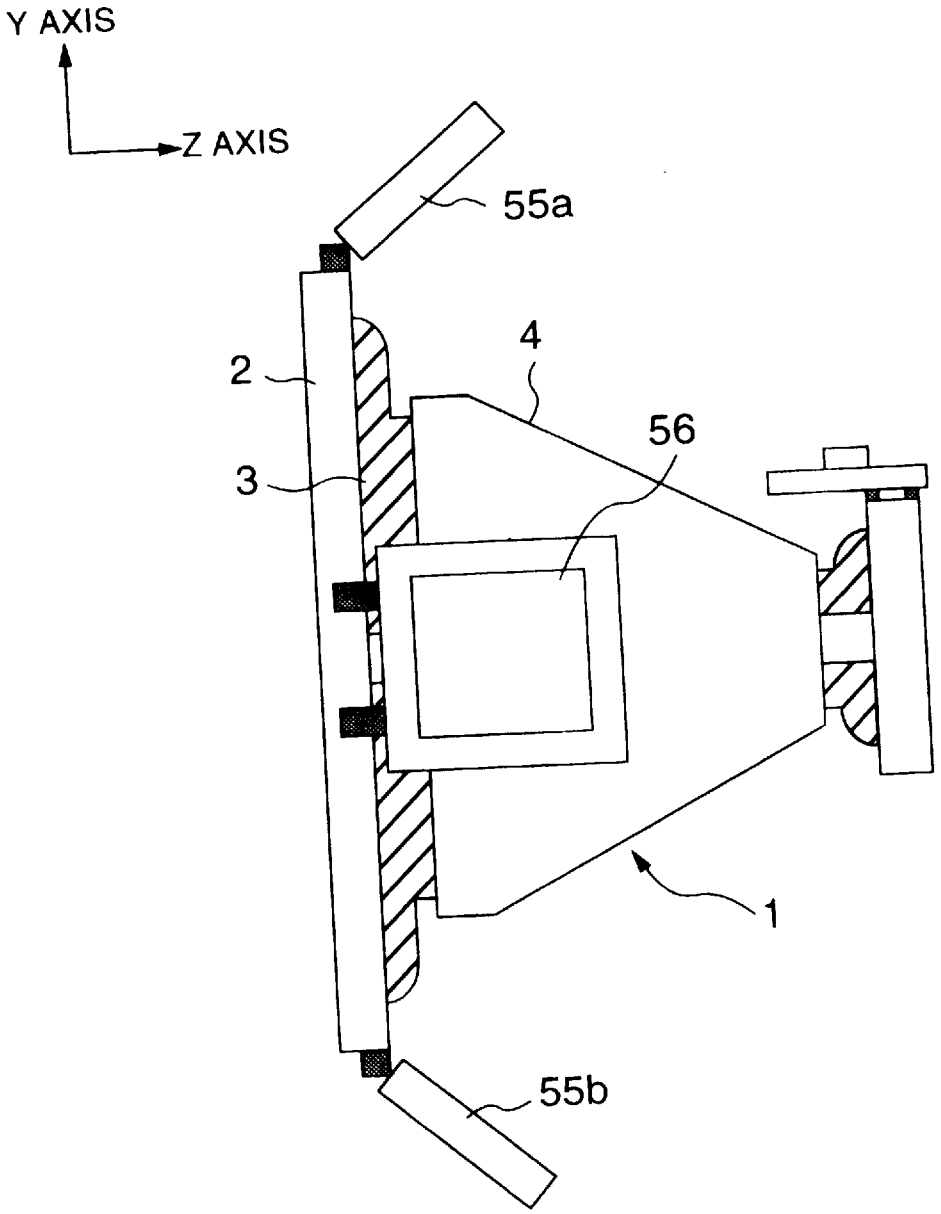
FIG.10 PRIOR ART
FIG. 10 is a plan view of an unnecessary magnetic field reducing device in the conventional cathode ray tube display device.

A fourth embodiment will be described referring to FIG. 9. The features of this embodiment lie in that first cancel coils 53*a* and 53*b* are disposed at positions close to the magnetic ferrite core 4 and the open side fringe 31 of the vertical deflection coil 3 so as to face a spacing 33 between the ferrite core 4 and the open side fringe 31 of the vertical deflection coil 3, and that second cancel coils 54*a* and 54*b* are disposed at positions close to the ferrite core 4 and the neck side fringe 34 of the vertical deflection coil 3 so as to face a spacing 34 between the ferrite core 4 and the neck side fringe 32 of the vertical deflection coil 3.

Like the cancel coils 53*a* and 53*b* of the third embodiment, the second cancel coins 54*a* and 54*b* are disposed such that the position of the strong one of the canceling magnetic fields which will be generated by the second cancel coils 54*a* and 54*b* coincides with the spacing 34 between the ferrite core 4 and the neck side fringe 32. That is, unnecessary radiating magnetic field reducing means is provided which further reduces the unnecessary radiating magnetic field 7 due to the magnetic field leaking from the vertical deflection coil 3 reduced in the first embodiment.

The first and second cancel coils 53*a*, 53*b* and 54*a*, 54*b* are adjusted in size and the number of turns so as to minimize the unnecessary radiating magnetic field 7.

While in the above description reduction of the unnecessary radiating magnetic field 7 due to the leaking magnetic field from the vertical deflection coil 3 has been illustrated, the unnecessary radiating magnetic field is further reduced by providing in the deflection yoke 1 means for reducing the unnecessary radiating magnetic field which will be generated from the horizontal deflection coil. The means for reducing the unnecessary radiating magnetic field from the horizontal deflection coil may be arranged like the above-mentioned inventive cancel coils to improve the reducing effect, of course.

The cancel coils may take the form of a square or a shape curved in conformity to the outer periphery of the ferrite core.

According to the present invention, unnecessary radiating magnetic field reducing means is provided which includes at least a pair of coils disposed in opposing relationship on the opposite sides of the ferrite core of the deflection yoke on or close to the outer periphery of the ferrite core to generate a counter magnetic field which cancels the unnecessary radiating magnetic field due to the magnetic field leaking from the deflection yoke.

When the ferrite core is made of a magnetic material, the inductance of a pair of coils between which the ferrite core is present is greater than that of a corresponding pair of air-core coils. Thus, a large magnetic field which will cancel the unnecessary radiating magnetic field is generated without using another ferromagnetic ferrite core between the coils.

Thus, a cathode ray tube display device is realized which has unnecessary radiating magnetic field reducing means to improve the ability to reduce an unnecessary radiating magnetic field, especially, generated by the vertical deflection coil.

What is claimed is:

1. A cathode ray tube display device which includes a cathode ray tube to which a deflection yoke is attached, the yoke having a horizontal and a vertical deflection coil for deflecting an electronic beam, and an unnecessary radiating magnetic field reducer for reducing an unnecessary radiating magnetic field due to a magnetic field leaking from the deflection yoke, said unnecessary radiating magnetic field reducer comprising at least one pair of coils disposed in opposing relationship on the opposite sides of a ferrite core on or close to the outer peripheral surface of the ferrite core for generating a canceling magnetic field which is opposite to the unnecessary radiating magnetic field due to the magnetic field leaking from the deflection yoke, wherein each of the at least one pair of coils has a curved shape conforming to the outer surface shape of the ferrite core in a circumferential direction and an axial direction thereof.

2. An cathode ray tube display device according to claim 1, wherein the ferrite core is made of a magnetic material and the at least pair of coils uses the ferrite core as the magnetic material to produce the canceling magnetic field.

3. An cathode ray tube display device according to claim 1, wherein at least a part of the pair of coils is in contact with the ferrite core.

4. An cathode ray tube display device according to claim 1, wherein the at least one pair of coils each is wound around a coil bobbin case which is fixed near or to the outer surface of the ferrite core.

5. An cathode ray tube display device according to claim 4, wherein the coil bobbin case has a shape conforming to the outer surface of the ferrite core.

6. An cathode ray tube display device according to claim 1, wherein the at least one pair of coils in opposing relationship is disposed along or near a horizontal axis of the deflection yoke so as to generate a canceling magnetic field which is opposite to an unnecessary radiating magnetic field due to the magnetic field leaking from the vertical deflection coil.

7. An cathode ray tube display device according to claim 1, wherein the at least one pair of coils in opposing relationship is disposed along or near a vertical axis of the deflection yoke so as to generate a canceling magnetic field which opposes an unnecessary radiating magnetic field due to a magnetic field leaking from the horizontal deflection coil.

8. A cathode ray tube display device according to claim 1, wherein the at least one pair of coils includes a first pair of coils disposed in opposing relationship along or near a horizontal axis of the deflection yoke so as to generate a canceling magnetic field which is opposite to an unnecessary radiating magnetic field due to a magnetic field leaking from the vertical deflection coil and a second pair of coils disposed in opposing relationship or near a vertical axis of the deflection yoke so as to generate canceling magnetic field which is opposite to an unnecessary radiating magnetic field due to a magnetic field leaking from the horizontal deflection coil.

9. An cathode ray tube display device according to claim 1, wherein the at least one pair of coils is provided so as to face a spacing between the ferrite core and the open side fringe of the vertical deflection coil.

10. An cathode ray tube display device according to claim 9, wherein the at least one pair of coils is provided on or close to the outer wall of the ferrite core and the open side fringe of the vertical deflection coil.

11. An cathode ray tube display device according to claim 1, wherein the at least one pair of coils comprises a first and a second pair of coils each pair disposed in opposing relationship on the opposite sides of the ferrite core, the first pair of coils being provided on or close to the outer wall of the ferrite core and the open side fringe of the vertical deflection coil and the second pair of coils being provided on or close to the outer wall and the neck side fringe of the vertical deflection coil.

* * * * *